US005871146A

United States Patent [19]

Onderko et al.

[11] Patent Number: 5,871,146

[45] Date of Patent: Feb. 16, 1999

[54] FLUID CARTON CONTAINER WITH PULL TAB

[76] Inventors: Patricia Onderko; Albert Onderko, both of 89 Fairmount Rd., Parsippany, N.J. 07054

[21] Appl. No.: 846,530

[22] Filed: Apr. 29, 1997

[51] Int. Cl.[6] ..... B65D 5/42

[52] U.S. Cl. ..... 229/160.2; 229/125.42; 229/249

[58] Field of Search ..... 229/160.2, 125.42, 229/213, 214, 249

[56] References Cited

U.S. PATENT DOCUMENTS

| | | | |
|---|---|---|---|
| 2,228,181 | 1/1941 | Perryman | 229/160.2 |
| 3,520,464 | 7/1970 | Pugh, Sr. | 229/160.2 |
| 4,821,950 | 4/1989 | Sanchez et al. | 229/160.2 |
| 4,874,126 | 10/1989 | Miller | 229/160.2 |
| 4,883,222 | 11/1989 | Fujisawa | 229/160.2 |
| 5,029,752 | 7/1991 | Andersson | 229/160.2 |
| 5,392,589 | 2/1995 | Buchanan | 229/160.2 |
| 5,503,327 | 4/1996 | Barnes | 229/160.2 |
| 5,516,037 | 5/1996 | Okamoto et al. | 226/160.2 |

FOREIGN PATENT DOCUMENTS

| | | | |
|---|---|---|---|
| 2253608 | 9/1992 | United Kingdom | 229/160.2 |
| 82/03370 | 10/1982 | WIPO | 229/160.2 |

*Primary Examiner*—Gary E. Elkins

[57] ABSTRACT

A fluid container has a pull tab for providing a way of easily opening beverage containers such as milk cartons. The pull tab is positioned at the upper spout area of the carton such that pulling the pull tab opens the seal at the top of the container.

4 Claims, 3 Drawing Sheets

FLUID CARTON CONTAINER WITH PULL TAB

BACKGROUND OF THE INVENTION

1. Field of the Invention

The present invention relates to accessory devices for handling milk cartons and more particularly pertains to a new Fluid Carton Container With Pull Tab for offering an easier manner of pulling a pour spout out of a milk carton.

2. Description of the Prior Art

The use of accessory devices for handling milk cartons is known in the prior art. More specifically, accessory devices for handling milk cartons heretofore devised and utilized are known to consist basically of familiar, expected and obvious structural configurations, notwithstanding the myriad of designs encompassed by the crowded prior art which have been developed for the fulfillment of countless objectives and requirements. The first step in opening a milk carton is typically easily accomplished because it involves spreading one side of the milk carton's top open by pushing outwardly to separate the milk carton's top and towards the center of the carton to fold the one side of the milk carton's top back to a common plane with the center of the carton. The second step is usually quite difficult because it involves pulling a middle panel of the one side of the milk carton's top outwardly so that a spout can be formed. This step is difficult because of a number of reasons; two of which are that it is more difficult to pull that to push and that there is nothing to grab from which to pull.

Known prior art accessory devices for handling milk cartons include U.S. Pat. No. 5,201,698; U.S. Pat. No. 4,921,104; U.S. Pat. No. 5,326,024; U.S. Pat. No. 5,135,159; U.S. Pat. No. 5,255,813 and U.S. Pat. No. 4,150,778.

While these devices fulfill their respective, particular objectives and requirements, the aforementioned patents do not disclose a new Fluid Carton Container With Pull Tab. The inventive device includes a milk carton, a sealed top, and a pull tab.

In these respects, the Fluid Carton Container With Pull Tab according to the present invention substantially departs from the conventional concepts and designs of the prior art, and in so doing provides an apparatus primarily developed for the purpose of offering an easier manner of pulling a pour spout out of a milk carton.

SUMMARY OF THE INVENTION

In view of the foregoing disadvantages inherent in the known types of accessory devices for handling milk cartons now present in the prior art, the present invention provides a new Fluid Carton Container With Pull Tab construction wherein the same can be utilized for offering an easier manner of pulling a pour spout out of a milk carton.

The general purpose of the present invention, which will be described subsequently in greater detail, is to provide a new Fluid Carton Container With Pull Tab apparatus and method which has many of the advantages of the accessory devices for handling milk cartons mentioned heretofore and many novel features that result in a new Fluid Carton Container With Pull Tab which is not anticipated, rendered obvious, suggested, or even implied by any of the prior art accessory devices for handling milk cartons, either alone or in any combination thereof.

To attain this, the present invention generally comprises a milk carton, a sealed top, and a pull tab.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Fluid Carton Container With Pull Tab apparatus and method which has many of the advantages of the accessory devices for handling milk cartons mentioned heretofore and many novel features that result in a new Fluid Carton Container With Pull Tab which is not anticipated, rendered obvious, suggested, or even implied by any of the prior art accessory devices for handling milk cartons, either alone or in any combination thereof.

It is another object of the present invention to provide a new Fluid Carton Container With Pull Tab which may be easily and efficiently manufactured and marketed.

It is a further object of the present invention to provide a new Fluid Carton Container With Pull Tab which is of a durable and reliable construction.

An even further object of the present invention is to provide a new Fluid Carton Container With Pull Tab which is susceptible of a low cost of manufacture with regard to both materials and labor, and which accordingly is then susceptible of low prices of sale to the consuming public, thereby making such Fluid Carton Container With Pull Tab economically available to the buying public.

Still yet another object of the present invention is to provide a new Fluid Carton Container With Pull Tab which provides in the apparatuses and methods of the prior art some of the advantages thereof, while simultaneously overcoming some of the disadvantages normally associated therewith.

Still another object of the present invention is to provide a new Fluid Carton Container With Pull Tab for offering an easier manner of pulling a pour spout out of a milk carton.

Yet another object of the present invention is to provide a new Fluid Carton Container With Pull Tab which includes a milk carton, a sealed top, and a pull tab.

Still another object of the present invention is to provide a new Fluid Carton Container With Pull Tab for providing a means of easily opening beverage containers such as milk cartons.

Yet another object of the present invention is to provide a new Fluid Carton Container With Pull Tab which includes a tab connected to an upper spout area of a beverage carton.

Still yet another object of the present invention is to provide a new Fluid Carton Container With Pull Tab that enables certain disabled persons or younger children to easily pull the tab of the present invention to open a beverage container such as milk cartons.

Even still another object of the present invention is to provide a new Fluid Carton Container With Pull Tab that includes a tab that can be made of the same material as the container and that includes a plurality of lines or ridges which allows users to easily grip and pull the tab when opening the container.

Still yet another object of the present invention is to provide a new Fluid Carton Container With Pull Tab that keeps milk cartons from unwanted, annoying tears.

Even still another object of the present invention is to provide a new Fluid Carton Container With Pull Tab that allows the user to conveniently pull out a pour spout of a milk carton.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 shows an enlarged cross sectional view of the top of the present invention while the container is in its pulled out position and therefore open.

DESCRIPTION OF THE PREFERRED EMBODIMENT

Figure 1:
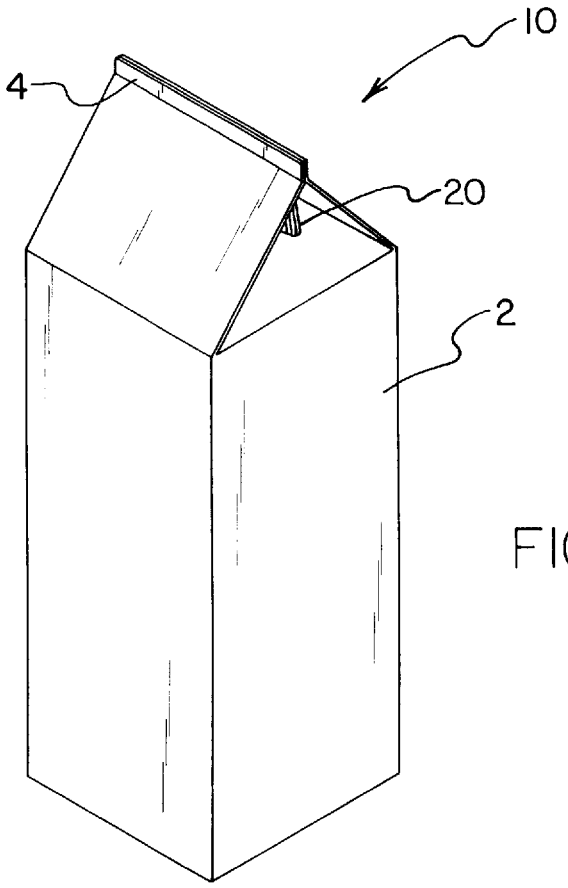
FIG. 1 is a top right front perspective view of a new Fluid Carton Container With Pull Tab according to the present invention.

With reference now to the drawings, and in particular to FIGS. 1 through 7 thereof, a new Fluid Carton Container With Pull Tab embodying the principles and concepts of the present invention and generally designated by the reference numeral 10 will be described.

More specifically, it will be noted that the Fluid Carton Container With Pull Tab 10 comprises a milk carton 2, a sealed top 4, and a pull tab 20 where the milk carton 2 includes the sealed top 4, and further includes the pull tab 20 for the purpose of pulling a spout out after a first glue tear has been accomplished.

As best illustrated in FIGS. 1 through 7, an ordinary milk carton is equipped with the pull tab such that the ordinary milk carton is sealed in a conventional manner where an inverted V is formed at the top of the carton and tipped in along a fold line and the top is sealed where a first side is folded in at an angle and sealed from the corners or sides, towards the center and a second side likewise is folded in at an angle and sealed from the corners or sides, towards the center and then folded over again, all in conventional fashion and all part of the prior art and therefore will not be explained in any greater detail in this application.

Figure 2:
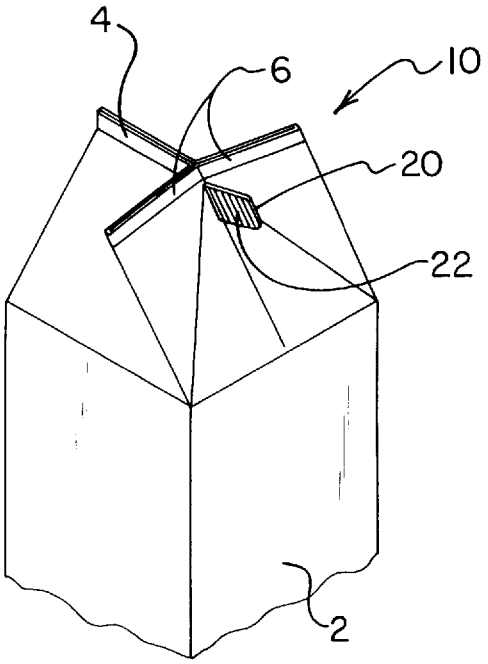
FIG. 2 is an enlarged top perspective view of the present invention showing a first step of using the present invention.
Figure 3:
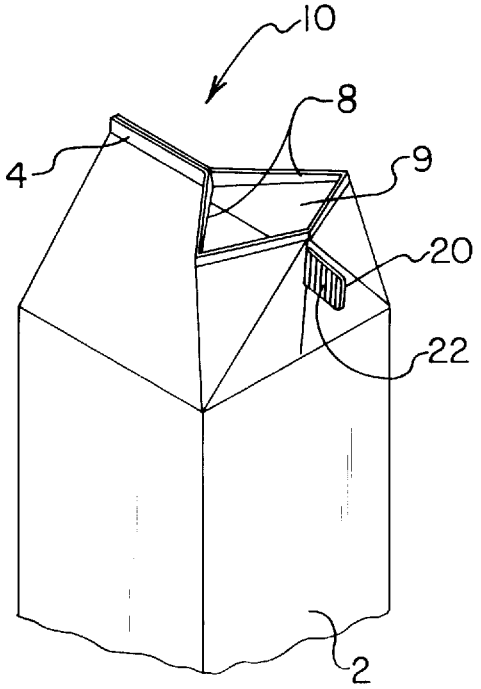
FIG. 3 is an enlarged top perspective view showing a second step using the present invention.
Figure 4:
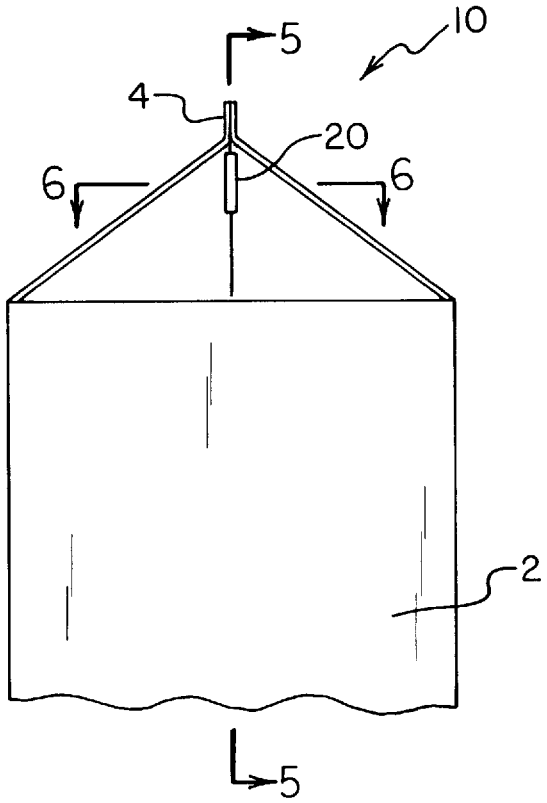
FIG. 4 is an enlarged elevation view of a milk carton top of the present invention.

Referring to FIG. 2 and FIG. 3, a pull tab 20 is fixedly attached to one of said sides of the top of the conventional milk carton 2 and as shown in FIG. 2, a first separation 6 is created by tearing a sealed top 4 apart at the top of the carton. The pull tab 20 then being exposed and having a grip tread 22 is then grasped between a thumb and a forefinger and pulled in a substantially horizontal fashion and tears open a second separation 8 from a glued seal and therefore creates a pour spout opening 9 from which the beverage can be poured or from which a person can drink.

Figure 5:
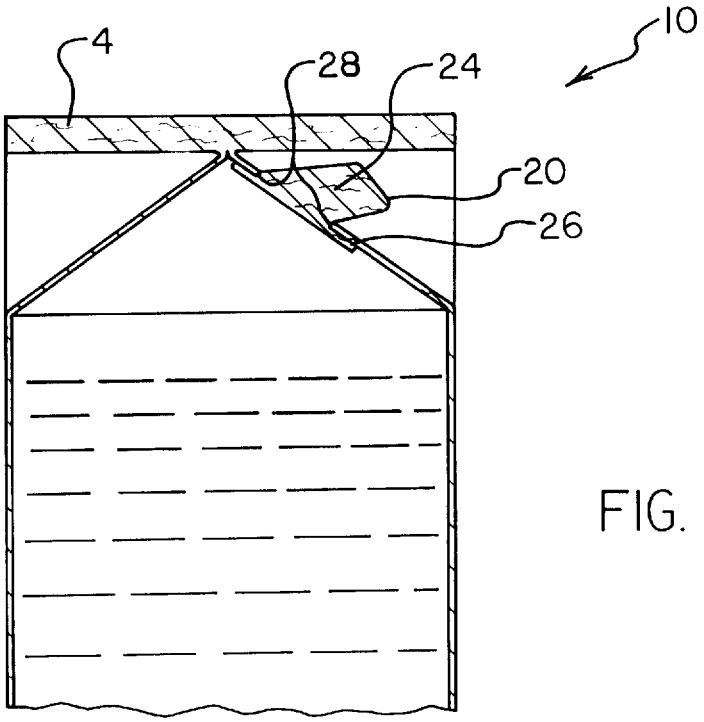
FIG. 5 is an enlarged cross sectional view taken along line 5—5 of FIG. 4 of the top of the present invention.
Figure 6:
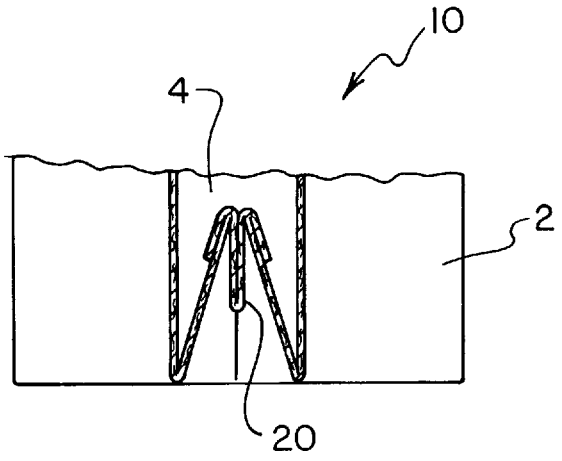
FIG. 6 is a cross sectional view taken along line 6—6 of FIG. 4 and shows an enlarged cross sectional view of the top of the present invention while the container is closed.
Figure 7:
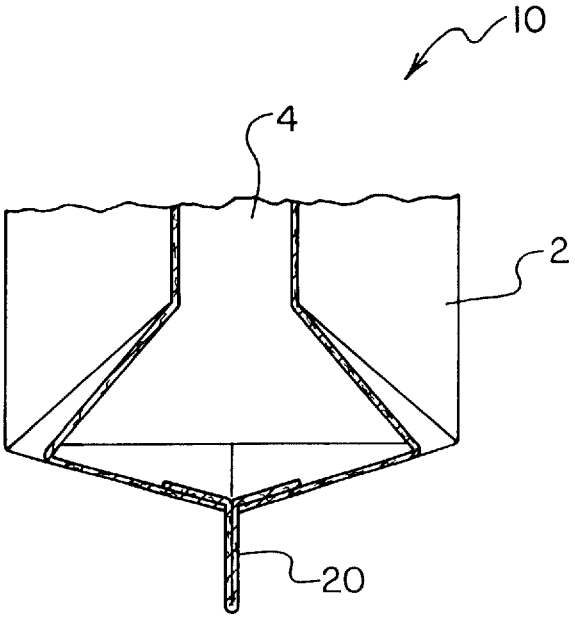
FIG. 7 is a cross sectional view like that of FIG. 6, however.

Referring to FIG. 5, the pull tab 20 is attachedly fixed to the milk carton 2 by insertion of the pull tab 20 through a pull tab aperture 28, and where the pull tab 20 further includes a sealed pull flange 26 which is an extension protrusion of the pull tab 20 and is fixedly attached orthogonally across an inner end of the pull tab 20 by a pull transition region 24 and where the sealed pull flange 26 is joined to the milk carton 2 by an adhesive fluid tight connection means.

ALTERNATE DESCRIPTION OF THE PREFERRED EMBODIMENT

The present invention includes generally a novel Easy Opening Tab for Beverage Cartons. The beverage carton is generally a typical beverage carton such as used to package milk and juice and the like. The carton of the present invention forms a foldable opening means that when opened forms a spout for pouring. The foldable opening means includes a tab means which is fixedly connected at about the center of a lower section of the foldable opening means so that when the lower section and an upper section forms a sealed relationship, the tab fits vertically downwards.

FIG. 5 shows an embodiment of the present invention. It indicates a tab adhesively affixed to the container. A suitable adhesive would be either a water base or hot melt adhesive which has a reasonable cold resistance and which forms a reasonable bond strength. In another embodiment, the present invention would comprise a container which is manufactured with the tab positioned on the lower section of the foldable opening means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid container and pull tab comprising, in combination:

a fluid container being formed from a substantially rectangular tube, said fluid container having a folded and sealed top such that a portion of said top is openable to form a pouring spout, said spout having a pair of substantially triangular forward sections and a center section, said center section being substantially triangular shaped, said center section further being positioned between said forward sections such that a forwardmost point of each of said pair of outermost edge sections and an apex of said center section meet at common point along a perimeter of said pouring spout; and a pull tab coupled to said center section, said pull tab being for facilitating opening of said pouring spout;

wherein said center section has a substantially centrally located slit therethrough into the interior of said container and located adjacent to said spout opening; and wherein said pull tab has a pair of mounting ears extending through said slit into the interior of said carton container with a body portion of said pull tab being located outside of said carton container, each said mounting tab being mounted to the interior surface of said carton container at a side of said slit opposite the side where the other said mounting tab is mounted.

2. The fluid container and pull tab of claim 1 wherein said pull tab is positioned proximate said apex of said center section.

3. The fluid container and pull tab of claim 2 further comprising:

a plurality of ridges positioned on said pull tab, said plurality of ridges being for providing a gripping surface on opposite sides of said pull tab.

4. A fluid container and pull tab comprising, in combination:

a fluid container being formed from a substantially rectangular tube, said fluid container having a folded and sealed top such that a portion of said top is openable to form a pouring spout, said spout having a pair of substantially triangular forward sections and a center section, said center section being substantially triangular shaped, said center section further being positioned between said forward sections such that a forwardmost point of each of said pair of outermost edge sections and an apex of said center section meet at common point along a perimeter of said pouring spout;

a pull tab coupled to said center section, said pull tab being for facilitating opening of said pouring spout;

wherein said pull tab is positioned proximate said apex of said center section;

a plurality of ridges positioned on said pull tab, said plurality of ridges being for providing a gripping surface on opposite sides of said pull tab;

said center section having a substantially centrally located slit therethrough into the interior of said container and located adjacent to said spout opening; and said pull tab having a pair of mounting ears extending through said slit into the interior of said carton container with a body portion of said pull tab being located outside of said carton container, each said mounting tab being mounted to the interior surface of said carton container at a side of said slit opposite the side where the other said mounting tab is mounted.

* * * * *